US012687081B1

(12) United States Patent
Zheng et al.

(10) Patent No.: US 12,687,081 B1
(45) Date of Patent: Jul. 21, 2026

(54) APPARATUS FOR CENTRALIZATION OF DOWNHOLE MILLING BIT

(71) Applicant: Halliburton Energy Services, Inc., Houston, TX (US)

(72) Inventors: Dezhi Zheng, Houston, TX (US); Rodney Marlow, Spring, TX (US); Pramod Chamarthy, Carrollton, TX (US); Mark Marcos Pina, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 19/071,248

(22) Filed: Mar. 5, 2025

(51) Int. Cl.
*E21B 29/00* (2006.01)
*E21B 10/26* (2006.01)

(52) U.S. Cl.
CPC ..... *E21B 29/00* (2013.01); *E21B 10/26* (2013.01)

(58) Field of Classification Search
CPC ..... E21B 10/02; E21B 10/26; E21B 29/00; E21B 29/002; B23B 51/0426; B23B 51/0473
See application file for complete search history.

(56) References Cited

U.S. PATENT DOCUMENTS 2,800,812 A * 7/1957 Mueller ..... B23B 51/044 408/67
3,854,840 A * 12/1974 Miyanaga ..... B23B 51/0473 408/208
3,976,387 A * 8/1976 Segal ..... B23B 51/0473 144/23
5,907,110 A 5/1999 Garcia et al.
6,116,827 A * 9/2000 Moser ..... B23B 51/0473 175/405
6,120,221 A * 9/2000 Alm ..... B23B 51/0473 408/209
6,206,616 B1 * 3/2001 Smith ..... B23B 51/044 408/208
6,379,089 B1 * 4/2002 Sugiura ..... B23B 51/0473 279/22

(Continued)

FOREIGN PATENT DOCUMENTS

DE 4141045 A1 * 6/1993 ..... E21B 10/26
GB 641513 A * 8/1950 ..... B23B 51/0426

(Continued)

OTHER PUBLICATIONS

International Search Report & Written Opinion; PCT Application No. PCT/US2025/019908; Mailed Nov. 26, 2025.

*Primary Examiner* — Jennifer H Gay
(74) *Attorney, Agent, or Firm* — NOVAK DRUCE CARROLL LLP

(57) ABSTRACT

Aspects of the subject technology relate to apparatus and methods for removing obstructions that may block a wellbore passageway. Such obstructions may have been caused by the occurrence of an undesired event. Examples of such undesired events include debris blocking a tube or casing or the failure of a valve that controllably links one part of a wellbore to another part of the wellbore. In either instance, a drilling and/or milling operation may be required to break through the obstruction. Tools of the present disclosure may include milling or drilling bits that are used to center a bit that is used to mill and/or drill through an obstruction.

20 Claims, 9 Drawing Sheets

(56) References Cited

U.S. PATENT DOCUMENTS

| | | | | |
|---|---|---|---|---|
| 7,357,605 | B2 * | 4/2008 | Weiler | B23B 51/0426 408/67 |
| 7,484,578 | B2 * | 2/2009 | Duncan | E21B 10/02 175/402 |
| 8,042,613 | B2 * | 10/2011 | Hallundbaek | E21B 10/26 408/208 |
| 8,113,748 | B2 * | 2/2012 | Werner | B23B 51/0453 408/68 |
| 11,530,589 | B2 * | 12/2022 | Hallundbæk | E21B 10/40 |
| 11,867,014 | B2 * | 1/2024 | Gabrielsen | E21B 29/002 |
| 12,139,986 | B2 * | 11/2024 | Giem | E21B 29/005 |
| 2006/0188349 | A1 * | 8/2006 | Weiler | B23B 51/0426 408/67 |
| 2007/0181342 | A1 * | 8/2007 | Duncan | E21B 10/02 175/57 |
| 2010/0086372 | A1 * | 4/2010 | Werner | B23B 51/0453 408/1 R |
| 2010/0101802 | A1 * | 4/2010 | Hallundbaek | E21B 10/26 175/58 |
| 2021/0301616 | A1 * | 9/2021 | Hallundbæk | E21B 10/26 |
| 2023/0091081 | A1 * | 3/2023 | Gabrielsen | E21B 10/02 166/376 |
| 2023/0121660 | A1 | 4/2023 | Spinnangr | |
| 2023/0313627 | A1 * | 10/2023 | Giem | E21B 34/14 166/55.7 |
| 2024/0100609 | A1 * | 3/2024 | Sanogo | B23B 51/0426 |

FOREIGN PATENT DOCUMENTS

| | | | | |
|---|---|---|---|---|
| NO | 20220208 | A1 * | 8/2022 | E21B 29/002 |
| WO | 2008104179 | A2 | 9/2008 | |
| WO | WO-2009021278 | A1 * | 2/2009 | B23B 51/0473 |
| WO | 2022050966 | A1 | 3/2022 | |
| WO | 2022051720 | A1 | 3/2022 | |

* cited by examiner

400-A

400-B

400-C

APPARATUS FOR CENTRALIZATION OF DOWNHOLE MILLING BIT

TECHNICAL FIELD

The present technology pertains to improving the operation of wellbore perforation devices, and more particularly, to devices that once deployed may be used to help identify constituent components of fluids present in underground strata.

BACKGROUND

Wellbores are commonly used for various purposes that include gas and oil production, carbon sequestration, and hydraulic fracturing. When wellbores are used, passageways located inside of a wellbore casing, tube, or other structure may be blocked by an obstruction. In certain instances, such passageways may be blocked by the presence of debris or may be blocked when a downhole valve fails.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings.

DETAILED DESCRIPTION

Figure 1:
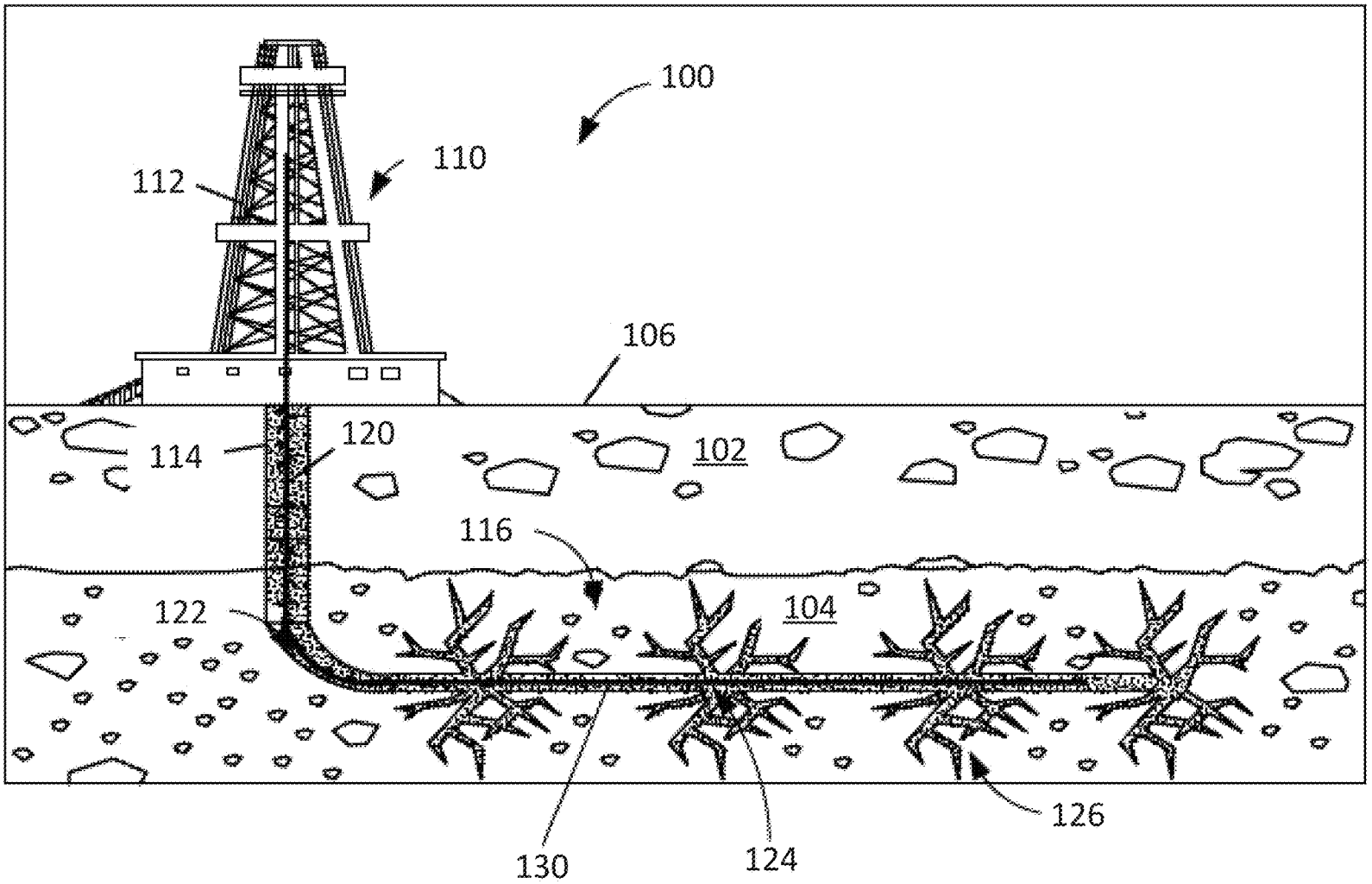
FIG. 1 illustrates a schematic view of an example wellbore operating environment, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

In various instances, one area of a wellbore may be separated from another area of the wellbore by an obstruction that blocks a passageway. Such obstructions may have been caused by the occurrence of an undesired event. Examples of such undesired events include debris blocking a tube or casing or the failure of a valve that controllably links one part of a wellbore to another part of the wellbore. In either instance, a drilling and/or milling operation may be required to break through the obstruction. Tools of the present disclosure may include milling or drilling bits that are used to center a bit that is used to mill and/or drill through an obstruction. When a valve is used, that valve may be configured to be controlled to switch between an open position and a closed position. One type of valve that may be used is a ball valve.

FIG. 1 illustrates a schematic view of an example wellbore operating environment. As depicted in FIG. 1, example operating environment 100 includes a wellbore 114 that penetrates a formation 102. Such perforations may be performed for the purpose of recovering hydrocarbons from formation 104, storing hydrocarbons, or injecting substances (e.g., fracturing fluids, water, or carbon dioxide) into formation 104. In certain instances, the purpose of operating environment 100 may be for carbon capture & storage (CCS), and such operations may use equipment that are not shown in FIG. 1. In other instances, the purpose of operating environment 100 may be associated with capturing geothermal energy, and such operations may use components that are not shown in FIG. 1.

As depicted in FIG. 1, formation 102, 104 are subterranean formations, although it is noted that formations 102, 104 may be a subsea formation. In certain locations, there are a plurality of underground formations 102, 104. Wellbore 114 may extend substantially vertically away from surface 106 over a vertical wellbore portion or may deviate at any angle from surface 106 over a deviated or horizontal wellbore portion 116. In alternative operating environments, portions or substantially all of the wellbore 114 may be vertical, deviated, horizontal, and/or curved. Wellbore 114 may be drilled into the formations 102, 104 using any suitable drilling technique. As shown, a drilling or servicing rig 110 disposed at the surface 106 (which may be the surface of the Earth, a seafloor surface, or a sea surface) comprises a derrick 112 from which a tubular string 120 (e.g., a drill string, a tool string, a segmented tubing string, a jointed tubing string, or any other suitable conveyance, or combinations thereof) is positioned within or partially within the wellbore 114. The tubular string 120 may include two or more concentrically positioned strings of pipe or tubing (e.g., a first work string may be positioned within a second work string). The drilling or servicing rig 110 may include a motor driven winch and other associated equipment for lowering the tubular string into the wellbore 114. Alternatively, a mobile workover rig, a wellbore servicing unit (e.g., coiled tubing units), or the like may be used to lower the work string into the wellbore 114. In such an environment, the tubular string 120 may be utilized in drilling, stimulating, completing, or otherwise servicing the wellbore, or combinations thereof. A drilling or servicing rig 110 may also comprise other equipment. In certain types of operations, a fluid 122 is forced down the tubular string 120 and out through perforations 124 to fracture the formations 104 that surround the perforations 124. The fluid may flow into such perforations when cracks 126 are formed and/or expanded in formation 104.

While FIG. 1 depicts a stationary drilling rig 110, one of ordinary skill in the art will readily appreciate that mobile workover rigs, wellbore servicing units (such as coiled tubing units), and the like may be employed. In the context of subsea environments and/or subsea formations, one of ordinary skill in the art will appreciate that conventional fixed platforms, vertically moored platforms, spar platforms, semi-submersible platforms, floating production facilities, and sub-sea completion facilities and the like may be employed. It is noted that while the figures or portions thereof may exemplify horizontal or vertical wellbores, the principles of the presently disclosed apparatuses, methods, and systems, may be similarly applicable to horizontal wellbore configurations, conventional vertical wellbore configurations, deviated wellbore configurations, and any combinations thereof. The horizontal, deviated, or vertical nature of any figure is not to be construed as limiting the wellbore to any particular configuration or formation.

Example operating environment 100 includes one or more sensors 130 deployed in wellbore 114. The operating environment 100 can include a completed well and the one or more sensors 130 can be deployed in the wellbore 114 after a well completion phase. Alternatively, the operating environment 100 can be during a well completion and the one or more sensors 130 can be deployed in the wellbore 114 after the well completion phase.

Figure 2A:
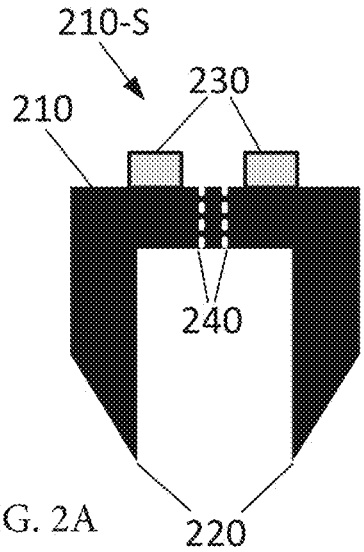
FIG. 2A illustrates a side view of a cutting element of milling/drilling tool, in accordance with various aspects of the subject technology.

FIGS. 2A-F illustrate parts of a tool that may be used to mill and/or drill through materials or parts that obstruct a wellbore passageway. As mentioned above, the passageway may be obstructed after an undesired event has occurred. FIG. 2A includes cutting element 210 and FIG. 2B includes a centering element 250, where centering element 250 may be configured to be coupled to cutting element 210.

Figure 2C:
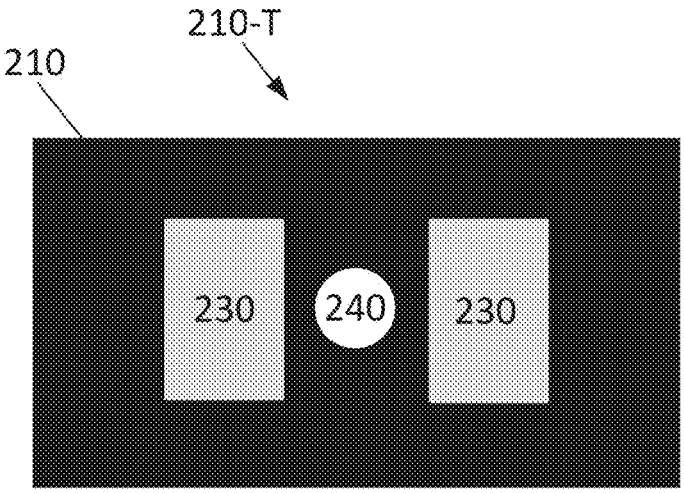
FIG. 2C illustrates an expanded top view of the cutting element, in accordance with various aspects of the subject technology.
Figure 2B:
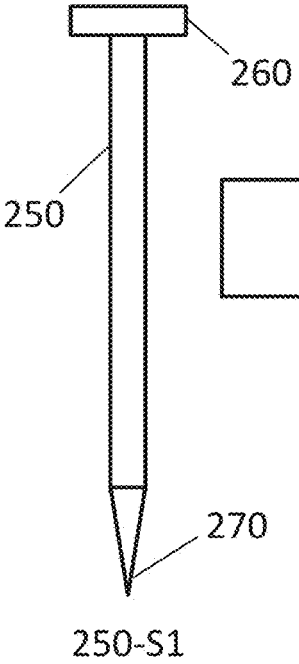
FIG. 2B illustrates a cross-sectional view of a centering element of the tool, in accordance with various aspects of the subject technology.
Figure 2E:
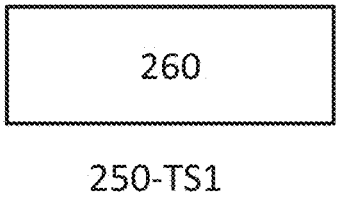
FIG. 2E illustrates an expanded view of a top portion of the centering element, in accordance with various aspects of the subject technology.
Figure 2D:
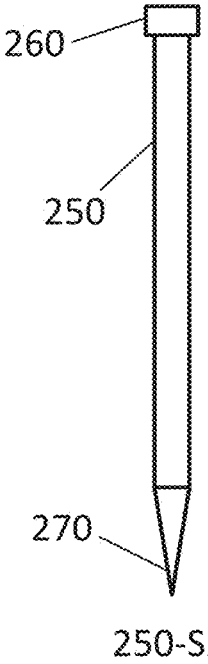
FIG. 2D illustrates a side view of the centering element, in accordance with various aspects of the subject technology.
Figure 2F:
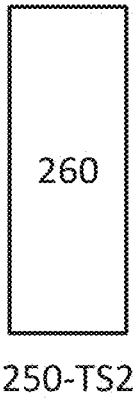
FIG. 2F illustrates another expanded view of a top portion of the centering element, in accordance with various aspects of the subject technology.

FIG. 2A includes a side view 210-S of cutting element 210, FIG. 2C shows an expanded top view 210-T of cutting element 210, FIG. 2B shows a first side view 250-S1 of centering element 250, and FIG. 2D shows a second side view 250-S2 of centering element 250. FIG. 2E also includes a first expanded view 250-TS1 of a top portion 260 of centering element 250 and FIG. 2F shows a second expanded view 250-TS2 of the top portion of centering element 250.

Cutting element 210 includes cutting surfaces 220, coupling parts 230, and hole 240. Side view 210-S shows hole 240 with dashed lines as hole 240 may not be visible to the eyes of a viewer when cutting element 210 is viewed from the side. Top view 210-T shows that coupling parts 230 may have a rectangular shape and that hole 240 may have a circular shape.

Views 250-S1 and 250-S2 respectively show centering element 250 from two different side perspectives. Note that centering element 250 may include a top potion 260 that may have a rectangular shape and a bottom end 270 that may have a pointed shape. Top view 250-S1 and top view 250-TS1 both illustrate the top portion 260 of centering element 250 in a first orientation. Top view 250-S2 and top view 250-TS2 both illustrate the top portion 260 of centering element in a second orientation. This first and second orientation of centering element 250 correspond to a simple rotation of centering element 250. Since the top portion 260 of centering element 250 has a rectangular shape, the apparent size of the top portion 260 of centering element 250 appear to have different sizes in view 250-S1 as compared to view 250-S2.

In FIGS. 2B and D, centering element 250 has a shape that is similar to a spike that has a rectangular shaped top portion 260. Centering element 250 may be coupled to cutting element 210 by passing its bottom end 270 through hole 240 of cutting element 210 and by rotating centering element 210. This rotation may cause the top portion 260 of centering element 250 to be coupled to cutting element based on coupling parts 230 engaging the top portion 260 of centering element 250 as illustrated in FIG. 3.

FIGS. 3A-D illustrate how different parts of the tool of FIGS. 2A-F may be connected together when a downhole milling bit assembly of the present disclosure is prepared to be deployed in a wellbore. Initially, the bottom end or tip 370 of centering element 350 may be passed through a hole in the top of cutting element 310 as arrow 380 indicates of view 300-S of FIG. 3 shows. While this top hole is not illustrated in FIGS. 3A-D, it may be similar to hole 240 of FIG. 2.

Figure 3A:
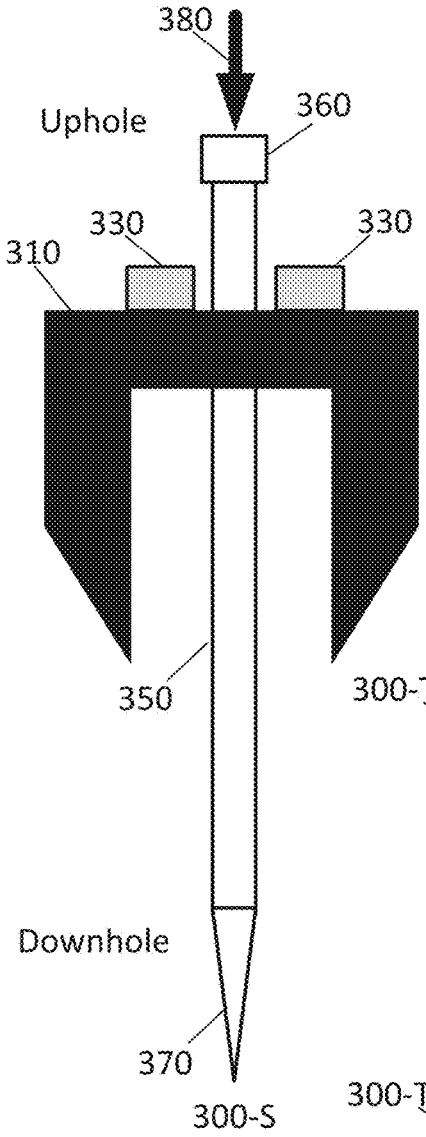
FIG. 3A illustrates a cross-sectional view of a tool, in accordance with various aspects of the subject technology.
Figure 3B:
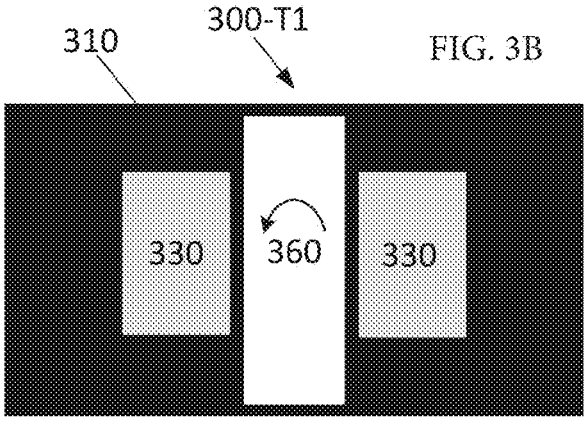
FIG. 3B illustrates a top cross-sectional view of the tool, in accordance with various aspects of the subject technology.
Figure 3C:
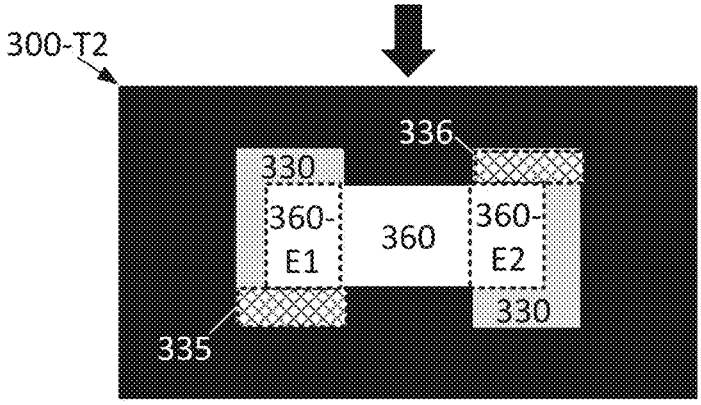
FIG. 3C illustrates another top cross-sectional view of the tool, in accordance with various aspects of the subject technology.
Figure 3D:
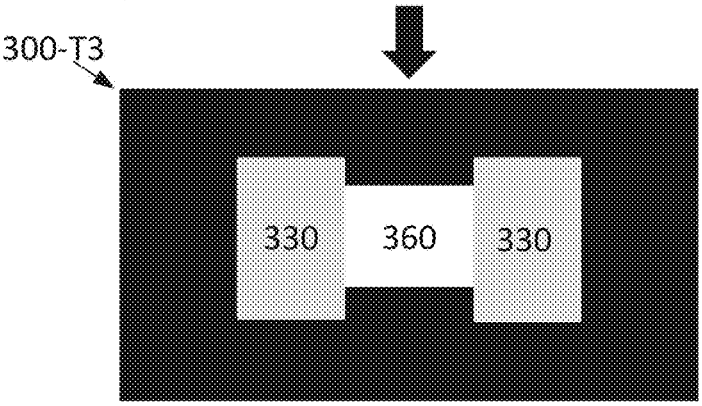
FIG. 3D illustrates another top cross-sectional view of the tool, in accordance with various aspects of the subject technology.

FIGS. 3B-D includes three different top views (300-T1, 300-T2, & 300-T3) of cutting element 310 when centering element 350 is coupled to the coupling parts 330 of cutting element 310. Top view 300-T1 shows top portion 360 of centering element 350 being located between the coupling parts 330 of cutting element 310 based on how this top portion 360 of centering element 350 is oriented. Once this top portion 360 is located between coupling parts 330 as shown in top view 300-T1, centering element 350 may be rotated (e.g., in a counterclockwise direction). The rotation of centering element 350 may cause ends (360-E1 & 360-E2) to abut stops 335 & 336, thereby coupling or latching centering element 350 to cutting element 310. As such, coupling parts 330 and stops 335 & 336 may act as a keyed retention mechanism that secures, locks, or latches the top portion 360 of centering element 350 to cutting element 310. As such, parts of a milling tool of the present disclosure may may be used to latch or unlatch centering element 350 to cutting element 310.

Top view 300-T2 is a semi-cross sectional top view of a downhole milling bit consistent with the present disclosure. Coupling parts 330 may have the shape of a C clamp, for example. Top view 300-T2 shows that centering element 350 may be rotated until ends 360-E1 & 360-E2 of the top portion 360 of centering element 350 lock in place. Top view 300-T3 is a top view of the downhole milling bit after cutting element 310 and centering element 350 have been coupled together.

Figure 4A:
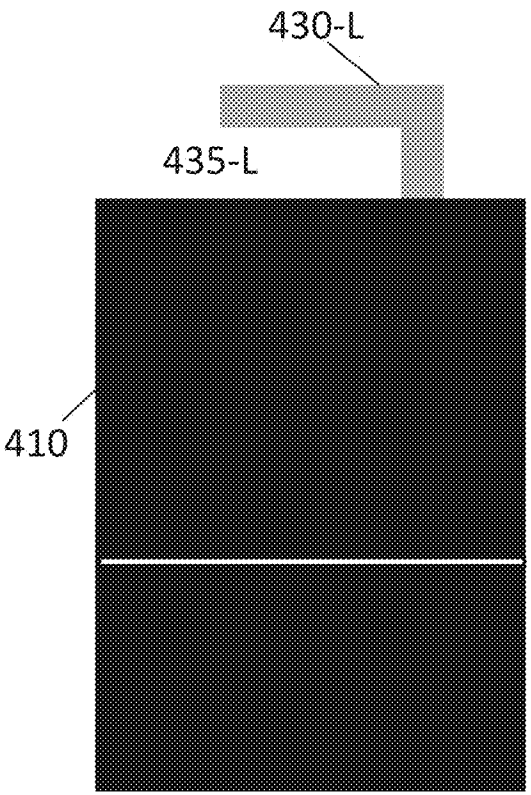
FIG. 4A illustrates a left side view of a cutting element of the tool, in accordance with various aspects of the subject technology.
Figure 4B:
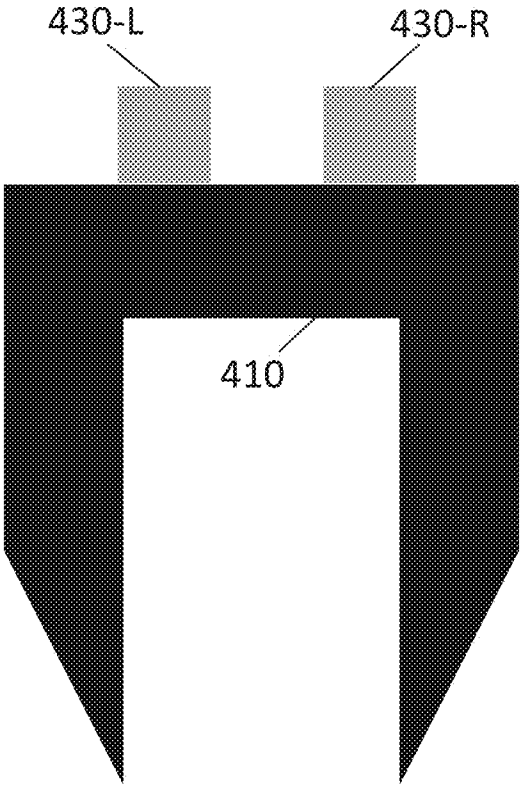
FIG. 4B illustrates a front view of the cutting element of the tool, in accordance with various aspects of the subject technology.
Figure 4C:
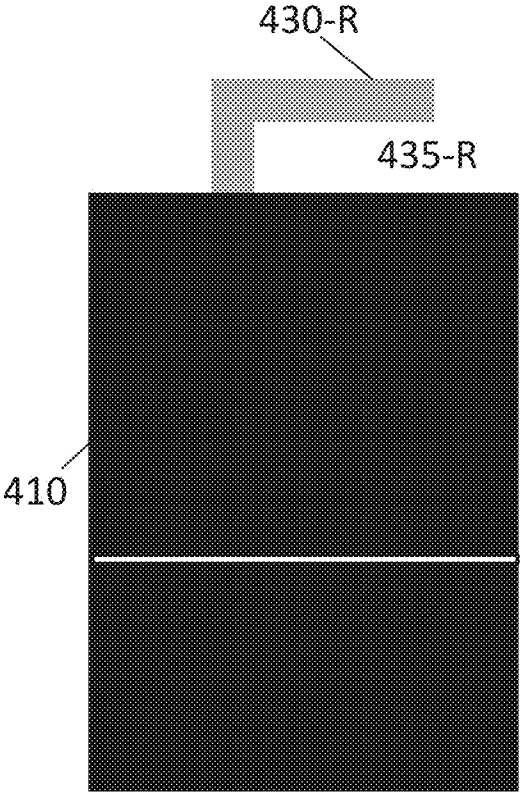
FIG. 4C illustrates a right side view of the cutting element of the tool, in accordance with various aspects of the subject technology.

FIGS. 4A-C illustrate three different views of a cutting element of a downhole milling bit consistent with the present disclosure. FIG. 4A includes a left side view 400-A, FIG. 4B includes a front view 400-B, and FIG. 4C includes a right side view 400-C of cutting element 410. The left side view 400-A of cutting element 410 shows a first coupling element 430-L and the right side view 400-C of cutting element 410 shows a second coupling element 430-R. The shape of the first coupling element 430-L forms opening 435-L and that the shape of the second coupling element 430-R forms opening 435-R. Note that openings 435-L & 435-R point in different directions, and because of this, these openings allow for coupling elements 430-L and 430-R to receive a top portion of centering element as discussed in respect to FIGS. 3A-D.

Figures 5A, 5B, 5C:
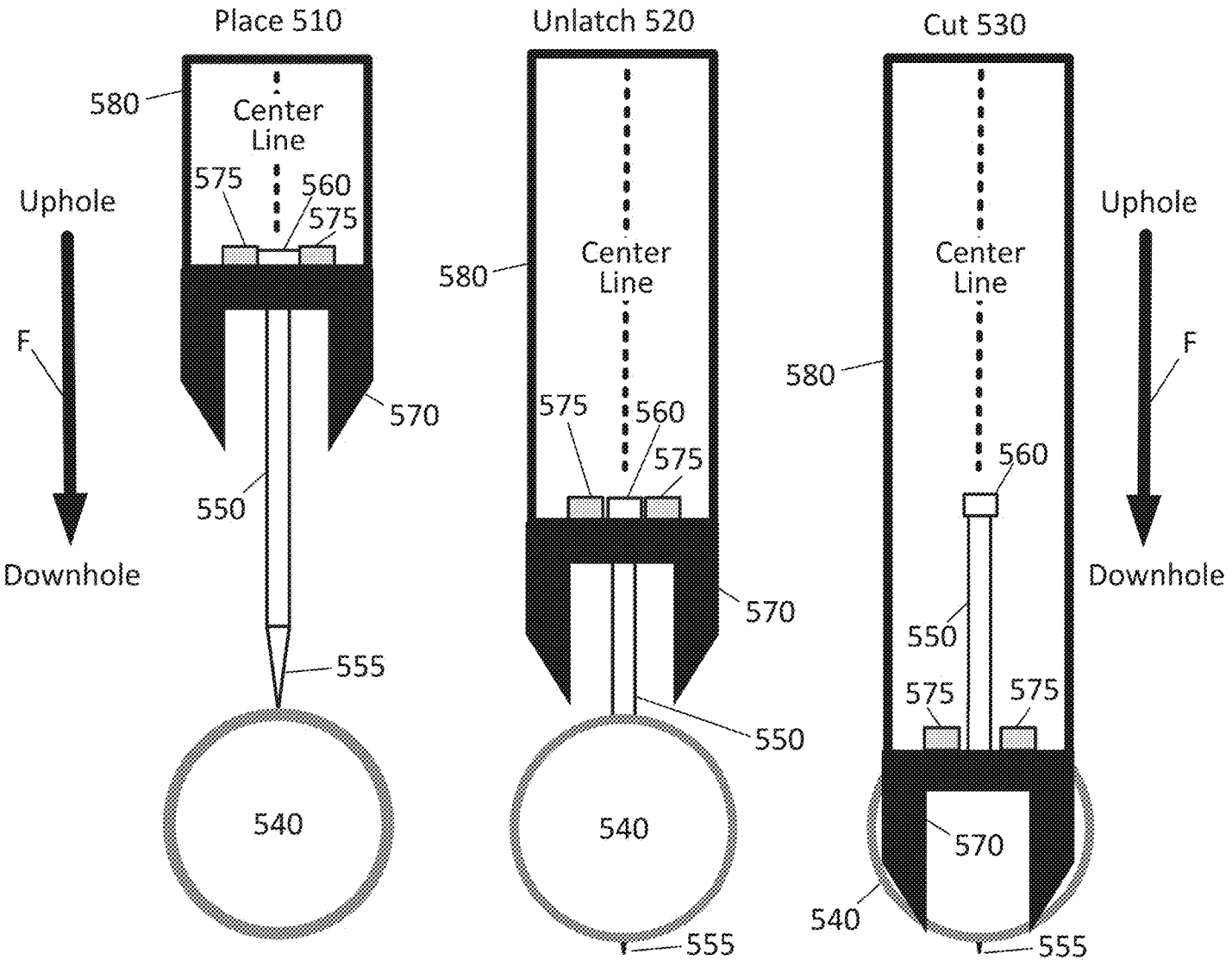
FIG. 5A illustrates an example placement action of the milling/drilling tool, in accordance with various aspects of the subject technology.
FIG. 5B illustrates an example unlatch action of the tool, in accordance with various aspects of the subject technology.
FIG. 5C illustrates an example cutting action of the tool, in accordance with various aspects of the subject technology.

FIGS. 5A-C illustrate a series of actions that may occur when a milling tool of the present disclosure is used. The actions illustrated in FIGS. 5A-C include placement action 510, unlatch action 520, and cutting action 530. The milling tool of FIG. 5 includes centering element 550, cutting element 570, and drill shaft 580. Initially centering element 550 may be connected to cutting element 570 in a manner that is consistent with how the downhole milling bit assembly of FIG. 3 is assembled. In an example, a portion of centering element 550 may be passed through a hole or receptacle in cutting element 570, this action may "flexibly attach" centering element 550 to cutting element 570. The term "flexibly attach" implies that centering element 550 may be able to move relative to cutting element 570 in at least one direction (e.g., in an up and down direction or along a center line of the milling tool as shown in FIG. 5). Once centering element 550 is attached to cutting element 570, these two pieces may be latched together based on a keying action of coupling parts 575 and top portion 560 of centering element 550. This process may form a milling bit assembly that includes centering element 550 and cutting element 570. The milling bit assembly may then be connected to drill shaft 580. Note that drill shaft 580 may be hollow or include a hollow space located above cutting element 570.

The milling tool may then be deployed into a wellbore until tip 555 of centering element 550 encounters obstruction 540. Such obstructions may be debris, part of a failed valve (e.g., a ball of a ball valve), or some other obstruction. When the milling tool is deployed, it may be deployed inside of a wellbore casing or tube, the milling tool may be lowered into that casing or tube until an obstruction is encountered. Placing the tool may include lowering the tool and then applying a force F that presses the tip 555 of centering element 550 toward obstruction 540. This may cause tip 555 of centering element 550 to poke or stab into obstruction 540. In some instances, a lower portion of centering element 550 may include threads that allow centering element to be used as a drill bit that drills into obstruction 540.

As such, tip 555 of centering element 550 may be located in the center of a casing, tube, or other structure that the tool is deployed in. The process of placing the cutting tool may include pressing tip 555 of centering element 550 into obstruction 540 and/or rotating drill shaft 580 in a first direction (e.g., clockwise). Once the cutting tool is in place, the drill shaft may be rotated in a second direction (e.g., counterclockwise) to move centering element 550 into an unlatched position.

Note that when rotation in a clockwise direction is used to latch a centering element to a cutting element, rotating the tool in the counterclockwise direction may be used to unlatch the centering element from the cutting element. In such instances, simply reversing the direction of rotation may result in the centering element moving from a latched position to the unlatched position.

After centering element 550 has been placed and moved to the unlatched position, cutting element 570 may be forced downhole. This may allow top portion 560 of centering element 550 to disengage from coupling parts 575 as cutting element 570 moves downhole. Force F may be applied to drill shaft 580 when cutting element 570 cuts into obstruction 540. At this time drill shaft 580 may be rotating (e.g., in a clockwise or counterclockwise direction) as cutting element 570 cuts into and/or through obstruction 540. Once the obstruction is cut through, the passageway previously blocked by the obstruction may no longer block the passageway.

FIG. 5B shows that unlatch action 520 may be performed after the centering element has poked or drilled into or through obstruction 540. Note that in some instances, tip 555 of centering element 550 may penetrate through from the top to the bottom portion of obstruction 540 as shown in the images that depict the unlatch action 520 and the cutting action 530 of FIG. 5C.

While the various figures show coupling parts releasably attached to a top portion of a centering element based on relative rotational motion between the centering element and a cutting element. Such a releasable connection may be based on slots included in coupling pieces, the present disclosure is not limited to such a configuration, however. The cutting element may be free to move axially relative to the centralizing element. This may be true even when the centralizing element is in a latched position. The centering element may have a keyed shape that allows the centralizing element to be bundled with/attached to the centralizing element, for example, as shown in FIG. 9.

Figure 6:
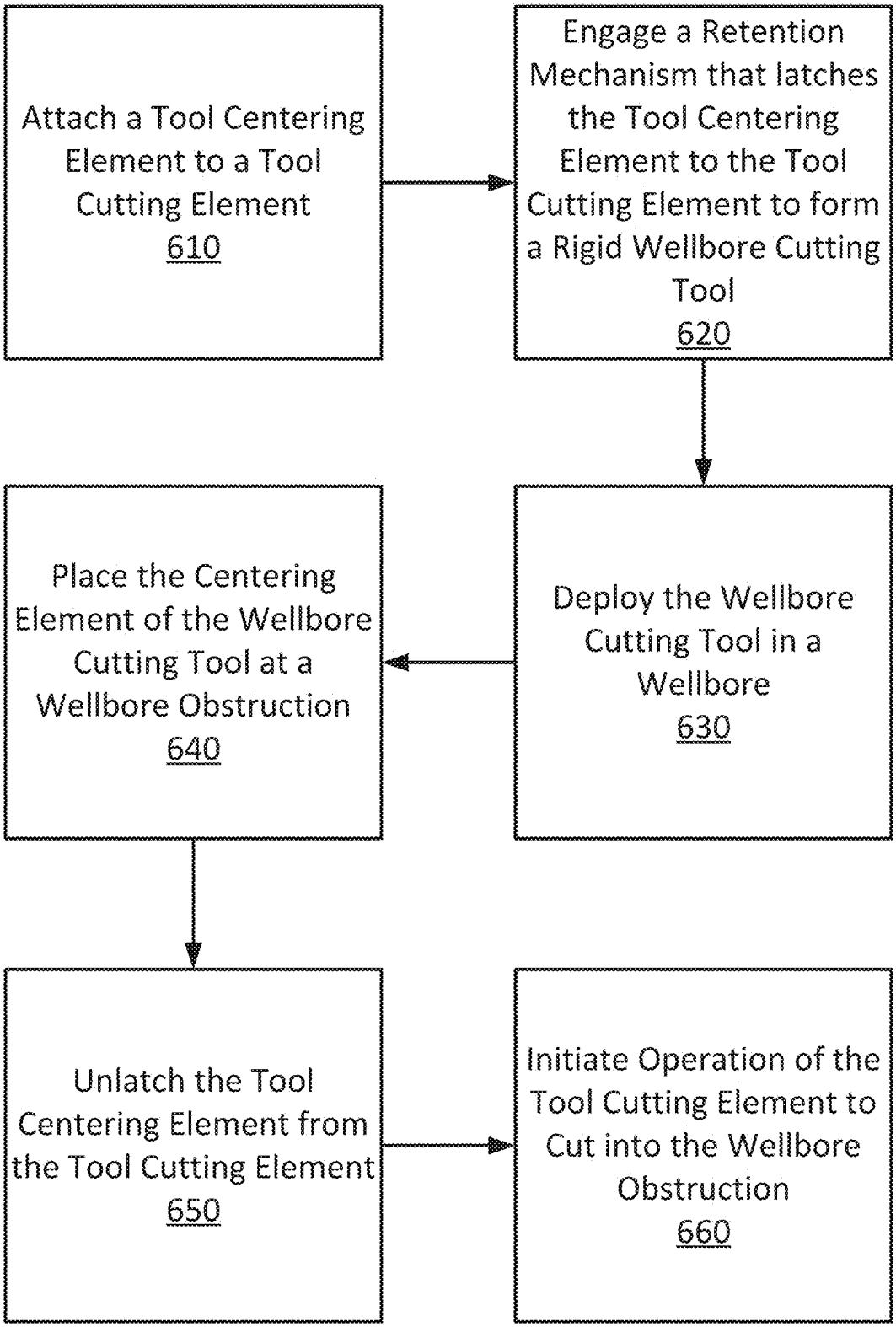
FIG. 6 illustrates a series of steps that may be used to keep motion of a milling and/or drilling tool along an axis, in accordance with various aspects of the subject technology.

FIG. 6 illustrates a series of steps that may be used to keep motion of a milling and/or drilling tool along an axis. Apparatuses of the present disclosure may prevent the milling and/or drilling tool from moving off center (by more than a threshold amount) and cutting into a wall of a casing, tube, or other apparatus within which the tool is deployed.

At block 610 a tool centering element may be attached to a tool cutting element. This may include passing a portion of the centering element through a hole or mount located in or on the cutting element as mentioned above in respect to FIG. 2. This may allow the cutting element to move relative to centering element when a retention mechanism that latches the centering element to the cutting element is in a released position. At this time and when the cutting tool is suspended in an orientation such that a tip of the centering element is located below (e.g., downhole from) the cutting element, the force of gravity may force the centering element to move downward until a top portion of the centering element touches a top (e.g., uphole) surface of the cutting element. Once the top portion of the centering element touches the top surface of the cutting element, the centering element may remain in place relative to the suspended cutting tool as long force is not applied to push the centering element upward. As such, the centering element may be "flexibly" attached to the cutting tool as discussed in respect to FIG. 5.

At block 620 a retention mechanism may be engaged. This retention mechanism may latch the tool centering element to the cutting element. Once latched, the retention mechanism may keep the tool centering element from moving upward relative to the cutting tool, thereby forming a "rigid" wellbore cutting tool.

At block 630 the wellbore cutting tool may be deployed in a wellbore. At block 640 the centering element of the wellbore cutting tool may be placed at a wellbore obstruction. Here again this placing may include poking or stabbing a tip portion of the centering element into the obstruction. This placing operation may also include drilling at least part of the centering element into or through the obstruction.

After the tool is placed at the obstruction, the retention mechanism that latches the centering element to the tool cutting element may be released at block 650. This may include rotating the cutting element in a direction that causes a keying/latching element to disengage the retention mechanism. This may include rotating a drill shaft that is coupled to the cutting element in a direction (e.g., a counterclockwise) that releases the keying/latching element.

At block 660, the operation of the tool cutting element may be initiated. This operation may include applying pressure to the drill shaft and rotating the drill shaft with a motor. At this point, the tool cutting element may be used to cut into and through the obstruction. After the obstruction has been overcome, a wellbore string that is attached to the wellbore cutting tool may be removed from the wellbore and the wellbore may be placed into service.

A cutting edge of the tool cutting element may be configured to cut when the drill shaft rotates in a first direction, in a second direction, or in either direction, this may depend on how cutting surfaces of the cutting element are shaped. In some instances, the centering element may be latched into place, the centering element may be placed at an obstacle, and the drill shaft may be rotated in a first direction such that a tip portion of the centering element can drill into the obstacle. The farther that the centering element protrudes into the obstruction may allow a position of the cutting element to be maintained along a center line of a wellbore casing or tube more effectively. The drill shaft may then be rotated in a second direction, and this may release the retention mechanism that latches the centering element to the cutting element. Rotation of the drill shaft may be maintained in the second direction as the cutting element is forced into the obstruction. This may allow the cutting element to cut through the obstruction without worrying about the retention mechanism inadvertently being moved to the latched position.

Figure 7:
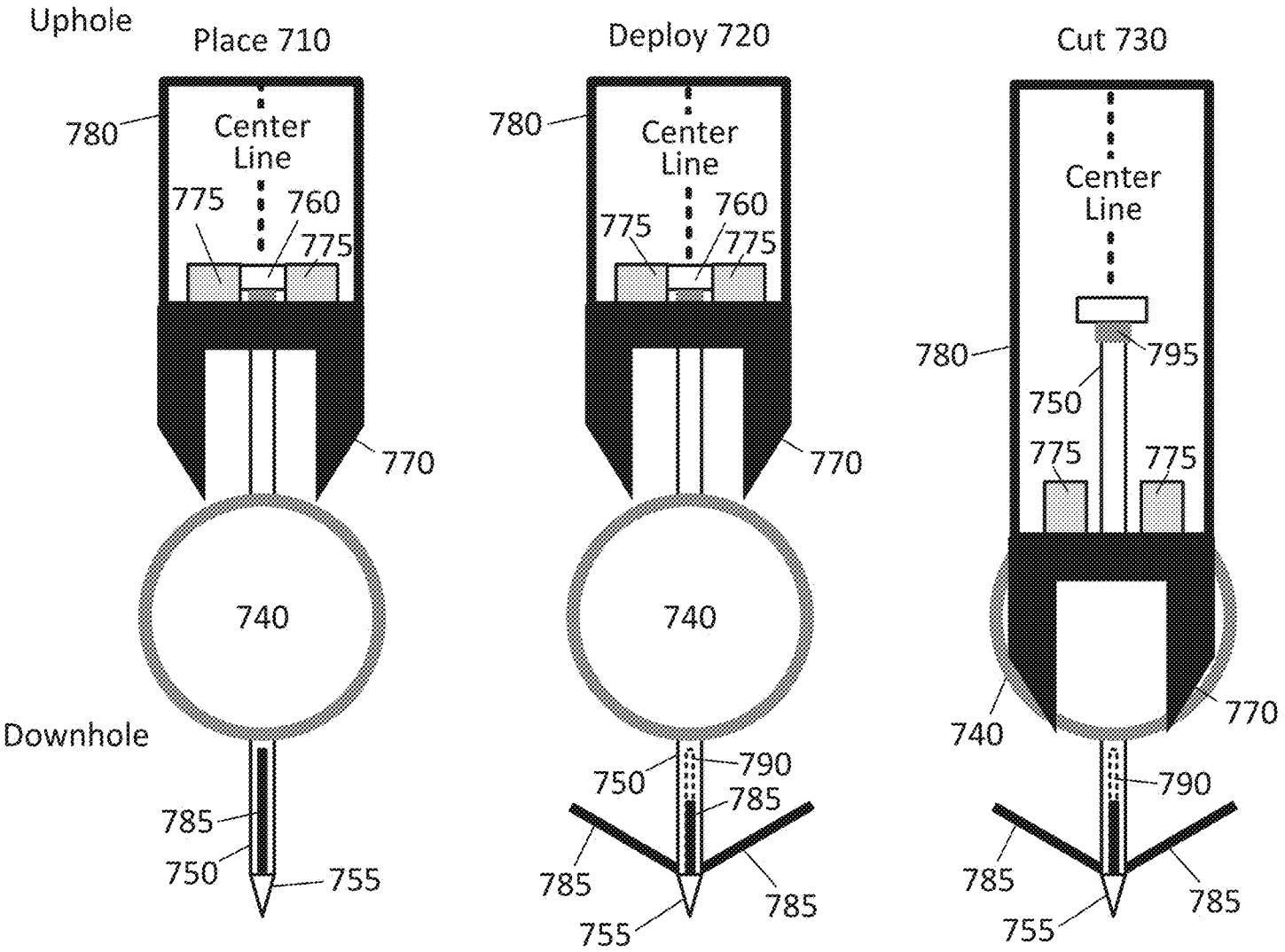
FIG. 7 illustrates a milling tool of the present disclosure that includes device capable of catching debris cut from a wellbore obstruction, in accordance with various aspects of the subject technology.

FIG. 7 illustrates a milling tool of the present disclosure that includes a device capable of catching debris cut from a wellbore obstruction. FIG. 7 illustrates the relative positions of parts of a milling tool when a placement action 710, a deploy action 720, and a cutting action 730 are performed. The milling tool of FIG. 7 includes centering element 750, cutting element 770, and drill shaft 780. Initially centering element 750 may be connected to cutting element 770 before the milling tool is deployed in a wellbore. Like the milling bit of FIG. 5, a centering element (e.g., centering element 750) may be passed through a hole or receptacle in a cutting element (e.g., cutting element 770) and centering element 750 may be coupled, be rigidly attached to, or be latched to cutting element 770. Cutting element 770 may then be attached to shaft 780 using any suitable coupling mechanism (e.g., latches 775). Such an attachment may allow rotational forces from shaft 780 to be transferred to centering element 750 via cutting element 770 when centering element and cutting element are latched together. Centering element 750 may include tip 755, top portion 760, and deployable catching element 785. Centering element 750 may be coupled to cutting element 770 based on latches 775 grabbing the top portion 760 of centering element 750.

Once the milling tool is assembled, it may be deployed into a wellbore until tip 755 of centering element 750 encounters obstruction 740. Such obstructions may be debris, part of a failed valve (an internal part of a valve such as a ball of a ball valve), or some other obstruction. When the milling tool is deployed, it may be deployed inside of a wellbore casing or tube, the milling tool may be lowered into that casing or tube until an obstruction is encountered. Placing the tool may include lowering the tool and then applying a force that presses the tip 755 of centering element 750 toward obstruction 740. This may cause tip 755 of centering element 750 to poke or stab into obstruction 740. In some instances, a lower portion of centering element 750 may include threads that allow centering element 750 to be used as a drill bit that drills into and possibly through obstruction 740 as shown in the placing action 710 of FIG. 7.

Tip portion 755 of centering element 750 may be located in the center of a casing, tube, or other structure that the tool is deployed in. The process of placing the cutting tool may include pressing tip 755 of centering element 750 into obstruction 740 and/or rotating drill shaft 780. Here placing action 710 may include drilling all the way through obstruction 740 until a shaft of centering element 750 passes through obstruction 740 to a point where catching element 785 can be deployed as shown in deploy action 720 of FIG. 7. Catching element 785 may include a plurality of flaps that may appear like ribs of an umbrella. The flaps of catching element 785 may fold into or be received by recess 790.

While not illustrated in FIG. 7, a catching element may be formed in the shape of an expandable cup or umbrella. In such an instance, this cup or umbrella may be made from a flexible piece (e.g., an elastomer) and pieces of sheet metal. Here the flexible piece may be connected to the flaps of catching element 785 of FIG. 7. Tip 755 may have a larger diameter than a shaft of centering element 750 and this may allow for the flaps and expandable piece (e.g., the aforementioned cup or umbrella) of a catching element to nestle above tip 755.

Figure 8:
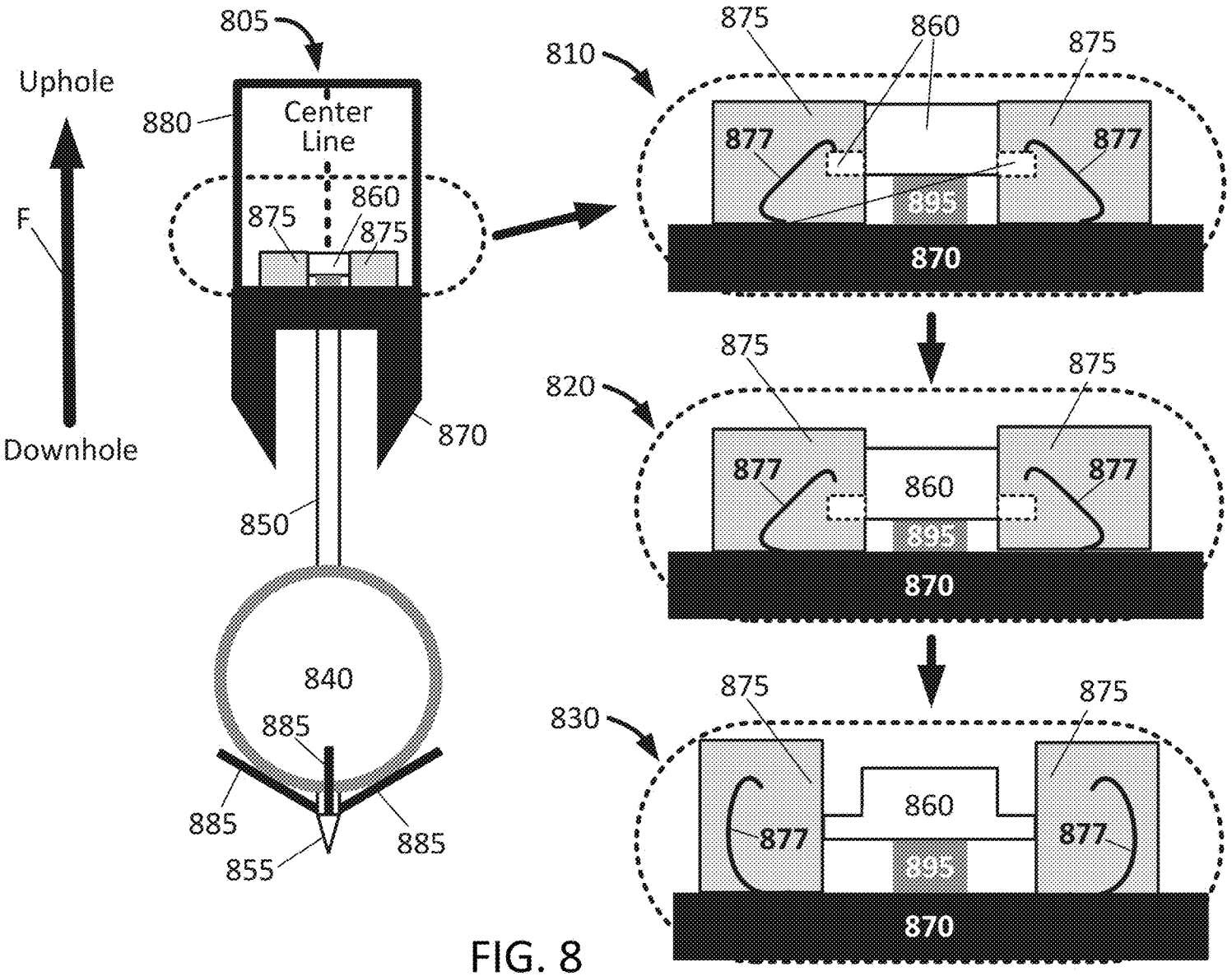
FIG. 8 illustrates elements of a milling tool where a centering element is coupled to a cutting element using a spring-loaded system, in accordance with various aspects of the subject technology.

After centering element 750 has been placed, centering element 750 may be unlatched from being rigidly connected to cutting element 770. An element that connects centering element 750 to cutting element 770 may include latches 775 that grab the top portion 760 of centering element 750. In certain instances, after flaps of catching element 785 have been deployed, shaft 780 of the milling tool may be pulled uphole and this may result in latches 775 moving to a release position based on operation of a spring-loaded latching system as shown in FIG. 8. Such a spring-loaded system may include spring 795 that when compressed results in latches 775 moving into an unlatched position.

After latches 775 are unlatched, shaft 780 may be moved downhole and cutting element 770 may cut through obstruction 740 as shown in the cutting action 730 of FIG. 7. Once, cutting element 770 has cut through obstruction 740, one or more pieces of the obstruction that were cut away may be caught by catching element 785.

FIG. 8 illustrates elements of a milling tool where a centering element is coupled to a cutting element using a spring-loaded system. FIG. 8 include views 805, 810, and 820. View 805 illustrates many of the same pieces discussed in respect to FIG. 7. Views 810, 820, and 830 are expanded semi-cross-sectional views of parts used to couple a top portion 860 centering element 850 of a milling tool to cutting element 870 of the milling tool.

View 805 includes centering element 850, cutting element 870, and shaft 880 of the milling tool. Centering element 850 may include tip portion 855, catching element 885, and top portion 860. Latches 875 may controllably engage the top portion 860 of centering element 850 (for example in a pin in hole configuration). After tip portion 855 of centering element 850 has drilled through obstruction 840 and catching element 885 has been deployed, shaft 880 may be moved uphole as indicated by force arrow F. This may result in catching element 885 cradling obstruction 840 and the uphole force applied to shaft 880 may result the release of latches 875. The oval shaped dashed line in view 805 represents an area of the milling tool that is shown in expanded views 810, 820, and 830 of FIG. 8.

Expanded views 810, 820, and 830 include the top portion 860 of centering element 850, compressible element or spring 895, latches 875, clips 877, and a top portion of cutting element 870. View 810 shows an engaged position of the spring-loaded latching system where clips 877 grab onto winged parts of the top portion 860 of centering element 850. As long as clips 877 engage the winged parts (shown using dashed lines) of the top portion 860 of centering element 850, centering element may be rigidly connected to cutting element 870.

View 805 shows a moment in time when clips 877 are decoupled from the winged parts of the top portion 860 of centering element 850. Note that obstructions (such as obstruction 840) that are drilled through will tend to be located underground at a fixed location. This means that an obstruction will tend to be rigidly connected to a wellbore structure. After catching element 885 has been deployed and since obstruction 840 is rigidly connected to wellbore structures, when centering element 850 is pulled uphole (as indicted by force arrow F), centering element 850 will be paced into tension. At this time, cutting element 870 will be pulled upward and the tension applied to centering element 850 will result in spring 895 being compressed. Once spring 895 is sufficiently compressed, clips 877 will be released from engaging the winged parts of the top portion 860 of centering element 850.

Once clips 877 are released, latches 875 may be free to rotate, as shown in view 830 of FIG. 8. As discussed in respect to FIGS. 5 & 7, once a latching mechanism is released, a cutting tool may be used to cut through an obstruction when a centering element of a milling tool is no longer rigidly attached to a cutting element of the milling tool.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Figure 9A:
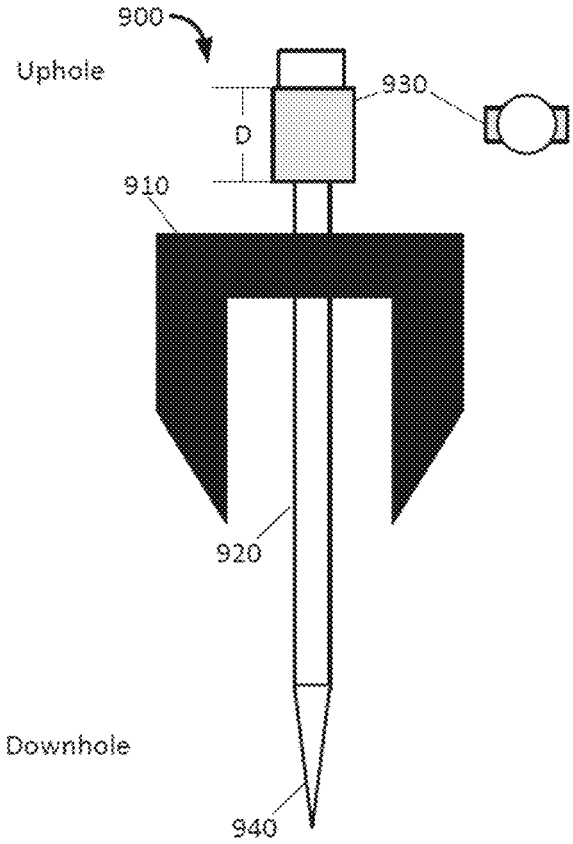
FIG. 9A illustrates a centralizing element and a cutting element of a wellbore cutting tool that fit together based on the centralizing element having a keyed shape, in accordance with various aspects of the subject technology.
Figure 9B:
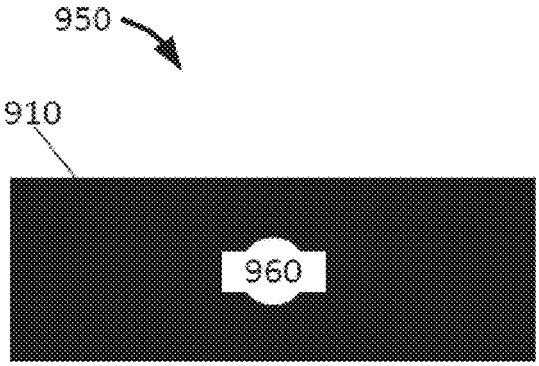
FIG. 9B illustrates a top view of an example cutting element of a wellbore cutting tool that fits together with the centralizing element based on the centralizing element having a keyed shape, in accordance with various aspects of the subject technology.

FIGS. 9A and 9B illustrate a centering element and a cutting element of a wellbore cutting tool that fit together based on the centering element having a keyed shape. FIG. 9A includes a side view 900 of cutting element 910 and centering element 920, where centering element 920 includes key shape portion 930 and tip 940. FIG. 9B also includes a top view 950 of cutting element 910 that includes key shaped slot/hole 960.

When keyed shape portion 930 of centering element 920 is received by keyed shaped slot/hole 960 in cutting element 910, centering element 920 will rotate when cutting element 910 is rotated. In certain instances, centering element 920 may be latched to cutting element 910 when the keyed shape portion 930 of centralizing element is received by the keyed shaped slot/hole 960 of cutting element 910.

Tip 940 of centering element 920 may be passed through slot/hole 960. When the cutting tool is deployed into a wellbore, tip 940 may be pressed into an obstruction. At this time, when cutting element 910 is rotated, centralizing element may also rotate based on key shaped portion 930 of centralizing element 910 being located in slot/hole 960. This may occur as centralizing element 910 pokes or is drilled into the obstruction. Downward force provided to cutting element 910 via a shaft may force centering element 920 upward relative to cutting element 910. When key 930 moves upward relative to cutting element 910 far enough, key 930 will no longer engage slot/hole 960 and cutting element 910 may rotate when centering element 920 does not rotate.

While a latching mechanism is not depicted in FIGS. 9A and 9B, the milling tool of FIGS. 9A and 9B may include a latching mechanism, for example, the latching mechanism of FIG. 3 or 8. In some instances, key 930 may tightly fit into slot/hole 960. Such a tight fit may require a force greater than a specified threshold force be applied before centering element 920 moves upward relative to cutting element 910. Because of this, a tight-fitting key may act as a retention or latching mechanism without needing another latch. In certain instances, a tight-fitting key and a secondary latch may be used. The length of key 930 may correspond to distance D shown in view 900 of FIG. 9A. Furthermore, this length (distance D) may be specified by a design rule of the milling tool.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1. An apparatus comprising: a centering element of a wellbore tool; a cutting element of the wellbore tool, wherein: the centering element of the wellbore too attaches to the cutting element of the wellbore tool based on a first portion of the centering element being passed through a hole in the cutting element; and a retention mechanism that controllably latches the centering element to the cutting element, wherein: the centering element rotates with the cutting element when the retention mechanism is in a latched position; the centering element does not rotate with the cutting element when the retention mechanism is in an unlatched position, and the cutting element moves downhole as the centering element stays in a fixed position when the retention mechanism is in the unlatched position based on a downhole force being applied to the cutting element.

Statement 2: The apparatus of statement 1, wherein the wellbore tool is configured to be deployed in a wellbore and placed at a wellbore obstruction and operation of the cutting element is initiated to cut into the obstruction.

Statement 3: The apparatus of statement 1 or 3, further comprising a drill shaft that is coupled to the cutting element.

Statement 4: The apparatus of any of statements 1 through 3, wherein the centering element includes a keyed shaped portion that fits into a keyed shaped hole of the cutting element.

Statement 5: The apparatus of any of statements 1 through 4, wherein the retention mechanism moves from the latched position to the unlatched position based on a force applied to the cutting element.

Statement 6: The apparatus of any of statements 1 through 5, wherein the retention mechanism includes friction associated with the keyed shaped portion of the centering element fitting into the keyed shaped hole of the cutting element.

Statement 7: The apparatus of any of statements 1 through 6, wherein the retention mechanism includes one or more clamps that engage a portion of the centering element.

Statement 8: The apparatus of any of statements 1 through 7, wherein a tip portion of the centering element includes threads that drill into a wellbore obstruction when the centering element rotates.

Statement 9: A method comprising: attaching a centering element of a wellbore tool to a cutting element of the wellbore tool based on a first portion of the centering element being passed through a hole in the cutting element; engaging a retention mechanism that controllably latches the centering element to the cutting element; placing the centering element of the wellbore tool at an obstruction; disengaging the retention mechanism that latches the tool centering element to the tool cutting element; and initiating operation of the wellbore tool to cut into the obstruction, wherein: the centering element rotates with the cutting element when the retention mechanism is in a latched position; the centering element does not rotate with the cutting element when the retention mechanism is in an unlatched position, and the cutting element moves downhole as the centering element stays in a fixed position when the retention mechanism is in the unlatched position based on a downhole force being applied to the cutting element.

Statement 10: The method of statement 9, further comprising: deploying the wellbore cutting tool in a wellbore;

placing the wellbore tool at an obstruction; and initiating operation of the cutting element to cut into the obstruction.

Statement 11: The method of statement 9 or 10, wherein a drill shaft is coupled to the cutting element.

Statement 12: The method of any of statements 9 through 11, wherein the centering element includes a keyed shaped portion that fits into a keyed shaped hole of the cutting element.

Statement 13: The method of any of statements 9 through 12, wherein the retention mechanism moves from the latched position to the unlatched position based on a force applied to the cutting element.

Statement 14: The method of any of statements 9 through 13, wherein the retention mechanism includes friction associated with the keyed shaped portion of the centering element fitting into the keyed shaped hole of the cutting element.

Statement 15: The method of any of statements 9 through 14, wherein the retention mechanism includes one or more clamps that engage a portion of the centering element.

Statement 16: The method of any of statements 9 through 16, wherein a tip portion of the centering element includes threads that drill into a wellbore obstruction when the centering element rotates.

Statement 17: The method of any of statements 9 through 16, wherein the placing of the wellbore tool at the obstruction includes forcing the centering element toward the obstruction.

Statement 18: The method of any of statements 9 through 17, wherein the placing of the wellbore tool at the obstruction includes drilling at least an end portion of the centering element into the obstruction.

Statement 19: The method of any of statements 9 through 18, further comprising: rotating the wellbore tool centering element in a first direction to engage the retention mechanism; and rotating the centering element in a second direction to disengage the retention mechanism.

Statement 20: The method of any of statements 9 through 19, further comprising: rotating the cutting element to cut into the obstruction.

What is claimed is:

1. A wellbore tool comprising:

a centering element of the wellbore tool;

a cutting element of the wellbore tool, wherein:

the centering element of the wellbore tool attaches to the cutting element of the wellbore tool based on a first portion of the centering element being passed through a hole in the cutting element; and a retention mechanism that controllably latches the centering element to the cutting element, wherein:

the centering element rotates with the cutting element when the retention mechanism is in a latched position;

the centering element does not rotate with the cutting element when the retention mechanism is in an unlatched position, and the cutting element moves downhole as the centering element stays in a fixed position when the retention mechanism is in the unlatched position based on a downhole force being applied to the cutting element.

2. The wellbore tool of claim 1, wherein the wellbore tool is configured to be deployed in a wellbore and placed at a wellbore obstruction and operation of the cutting element is initiated to cut into the obstruction.

3. The wellbore tool of claim 1, further comprising:

a drill shaft that is coupled to the cutting element.

4. The wellbore tool of claim 3, wherein a tip portion of the centering element includes threads that drill into a wellbore obstruction when the centering element rotates.

5. The wellbore tool of claim 1, wherein the centering element includes a keyed shaped portion that fits into a keyed shaped hole of the cutting element.

6. The wellbore tool of claim 5, wherein the retention mechanism includes friction associated with the keyed shaped portion of the centering element fitting into the keyed shaped hole of the cutting element.

7. The wellbore tool of claim 1, wherein the retention mechanism moves from the latched position to the unlatched position based on a force applied to the cutting element.

8. The wellbore tool of claim 1, wherein the retention mechanism includes one or more clamps that engage a portion of the centering element.

9. A method comprising:

attaching a centering element of a wellbore tool to a cutting element of the wellbore tool based on a first portion of the centering element being passed through a hole in the cutting element;

engaging a retention mechanism that controllably latches the centering element to the cutting element;

placing the centering element of the wellbore tool at an obstruction;

disengaging the retention mechanism that latches the tool centering element to the tool cutting element; and initiating operation of the wellbore tool to cause the cutting element to contact the obstruction and cut into the obstruction, wherein:

the centering element rotates with the cutting element when the retention mechanism is in a latched position;

the centering element does not rotate with the cutting element when the retention mechanism is in an unlatched position, and the cutting element moves downhole as the centering element stays in a fixed position when the retention mechanism is in the unlatched position based on a downhole force being applied to the cutting element.

10. The method of claim 9, further comprising:

deploying the wellbore tool in a wellbore;

placing the wellbore tool at the obstruction, thereby causing the cutting element to be positioned at the obstruction; and initiating operation of the cutting element to cut into the obstruction.

11. The method of claim 10, wherein the placing of the wellbore tool at the obstruction includes forcing the centering element toward the obstruction.

12. The method of claim 10, wherein the placing of the wellbore tool at the obstruction includes drilling at least an end portion of the centering element into the obstruction.

13. The method of claim 9, wherein a drill shaft is coupled to the cutting element.

14. The method of claim 9, wherein the centering element includes a keyed shaped portion that fits into a keyed shaped hole of the cutting element.

15. The method of claim 14, wherein the retention mechanism includes friction associated with the keyed shaped portion of the centering element fitting into the keyed shaped hole of the cutting element.

16. The method of claim 9, wherein the retention mechanism moves from the latched position to the unlatched position based on a force applied to the cutting element.

17. The method of claim 9, wherein the retention mechanism includes one or more clamps that engage a portion of the centering element.

18. The method of claim 9, wherein a tip portion of the centering element includes threads that drill into a wellbore obstruction when the centering element rotates.

19. The method of claim 9, further comprising:

rotating the wellbore tool centering element in a first direction to engage the retention mechanism; and rotating the centering element in a second direction to disengage the retention mechanism.

20. The method of claim 19, further comprising:

rotating the cutting element to cut into the obstruction.

* * * * *